US006598626B2

(12) United States Patent
Chaffee

(10) Patent No.: US 6,598,626 B2
(45) Date of Patent: Jul. 29, 2003

(54) SWITCHABLE INFLATION DEVICE

(75) Inventor: Robert B. Chaffee, 78 Montgomery St., Boston, MA (US) 02116

(73) Assignee: Robert B. Chaffee, Boston MA ( * ) Notice: Subject to any disclaimer, the term of this patent is extended or adjusted under 35 U.S.C. 154(b) by 0 days.

(21) Appl. No.: 09/867,130

(22) Filed: May 29, 2001

(65) Prior Publication Data

US 2002/0104579 A1 Aug. 8, 2002

Related U.S. Application Data

(62) Division of application No. 09/374,723, filed on Aug. 13, 1999, now Pat. No. 6,237,653.

(60) Provisional application No. 60/096,393, filed on Aug. 13, 1998.

(51) Int. Cl.[7] ..... B65B 1/04

(52) U.S. Cl. ..... 141/65; 141/67; 141/114; 141/313; 429/99

(58) Field of Search ..... 141/37, 38, 63, 141/64, 65, 114, 311 R, 313, 383, 384, 392; 429/99, 164–186

(56) References Cited

U.S. PATENT DOCUMENTS

| | | | | |
|---|---|---|---|---|
| 2,595,406 A | | 5/1952 | Popovich | |
| 2,803,527 A | * | 8/1957 | Lundahl | 200/60 |
| 3,086,698 A | | 4/1963 | Goldstein | |
| 4,515,872 A | | 5/1985 | Okano | |
| 4,678,014 A | * | 7/1987 | Owen et al. | 141/350 |
| 4,751,452 A | * | 6/1988 | Kilmer et al. | 310/50 |
| 5,184,309 A | | 2/1993 | Simpson et al. | |
| 5,535,849 A | | 7/1996 | Few | |
| 5,962,159 A | | 10/1999 | Satou et al. | |

FOREIGN PATENT DOCUMENTS

| | | |
|---|---|---|
| DE | 2554719 A1 | 6/1977 |
| DE | 2701556 A1 | 7/1978 |
| EP | 0852296 A2 | 7/1998 |

* cited by examiner

*Primary Examiner*—Steven O. Douglas
(74) *Attorney, Agent, or Firm*—Lando, Lowrie & Anastasi, LLP

(57) ABSTRACT

The invention relates to a fluid moving device for use with inflatable articles. The fluid moving device includes a fluid intake port, a motor and impeller assembly, and a fluid transfer orifice that provides the fluid. The fluid moving device also includes a power switch. The fluid moving device may be provided with a hand-holdable housing. The fluid moving device may also be provided with a battery compartment sized and arranged to fit a standard size set of batteries, and a removable battery container. The removable battery container may be sized and arranged to adapt differently sized batteries to the battery compartment. The power switch may also be a self-sealing power switch that seals the intake port when the power switch is in a deactivated position.

34 Claims, 9 Drawing Sheets

SWITCHABLE INFLATION DEVICE

RELATED APPLICATION

This application is a division of and claims priority under 35 U.S.C. §120 to commonly-owned, co-pending U.S. patent application Ser. No. 09/374,723, entitled "A Switchable Inflation Device," filed Aug. 13, 1999, and issued on May 29, 2001 as U.S. Pat. No. 6,237,653, which claims priority under 35 U.S.C. §119(e) to U.S. Provisional Patent Application Serial No. 60/096,393 entitled, "A Switchable Inflation Device," filed Aug. 13, 1998, which is hereby incorporated by reference in its entirety.

FIELD OF THE INVENTION

The invention relates to a fluid moving device for use primarily, but not exclusively, with low-pressure inflatable articles.

SUMMARY OF THE INVENTION

The invention in one embodiment is a device for filling a receptacle with a fluid. The device includes an intake port that provides for a fluid to be drawn into the device, a moving means for moving the fluid through the device to provide the fluid for filling the receptacle, and a fluid transfer orifice that provides the fluid to the receptacle. The device further includes a power switch for manually activating and deactivating the moving means. According to this embodiment, the device is provided with a hand-holdable housing that houses the intake port, the moving means, the fluid transfer orifice, and the power switch. The hand-holdable housing being shaped and arranged so that it may be cradled in one hand of a user with a single-handed user grip, the hand-holdable housing and the single-handed user grip allowing the fluid transfer orifice to be rotated into and out of engagement with the receptacle and also allowing the user to move the power switch with the same one hand to activate and deactivate the device.

In accordance with another embodiment of the invention, there is provided a fluid moving device that includes an intake port that provides for a fluid to be drawn into the fluid moving device, moving means for moving the fluid through the fluid moving device, and a fluid transfer orifice that provides the fluid. According to this embodiment, the fluid moving device is provided with a battery compartment having a size and arrangement to fit and provide electrical connection with a standard size set of batteries. In addition, the fluid moving device is provided with one of a removable battery container sized and arranged to adapt differently sized batteries to the size and arrangement of the battery compartment, so that the differently sized batteries can be electrically connected to the battery compartment, or a removable battery pack of differently sized batteries that is sized and arranged to be electrically connected to the battery compartment.

In accordance with yet another embodiment of the invention, there is provided a fluid moving device that includes a self-sealing intake port that provides for a fluid to be drawn into the fluid moving device, a moving means for moving the fluid through the fluid moving device, and a fluid transfer orifice that provides the fluid. According to this embodiment, the fluid moving device is also provided with a power switch for activating and deactivating the moving means. The power switch includes a self-sealing structure that seals the self-sealing intake port when the power switch is in a deactivated position, and that unseals the self-sealing intake port when the power switch is not in the deactivated position.

In accordance with still another embodiment of the invention, there is provided a battery-operated device that includes a battery compartment having a size and arrangement to fit and provide electrical connection with a standard size set of batteries. According to this embodiment, the battery-operated device is also provided with one of a removable battery container sized and arranged to adapt differently sized batteries to the size and arrangement of the battery compartment so that the differently sized batteries can be electrically connected to the battery compartment, or a removable battery pack of differently sized batteries being sized and arranged to be electrically connected to the battery compartment.

DETAILED DESCRIPTION

Figure 5:
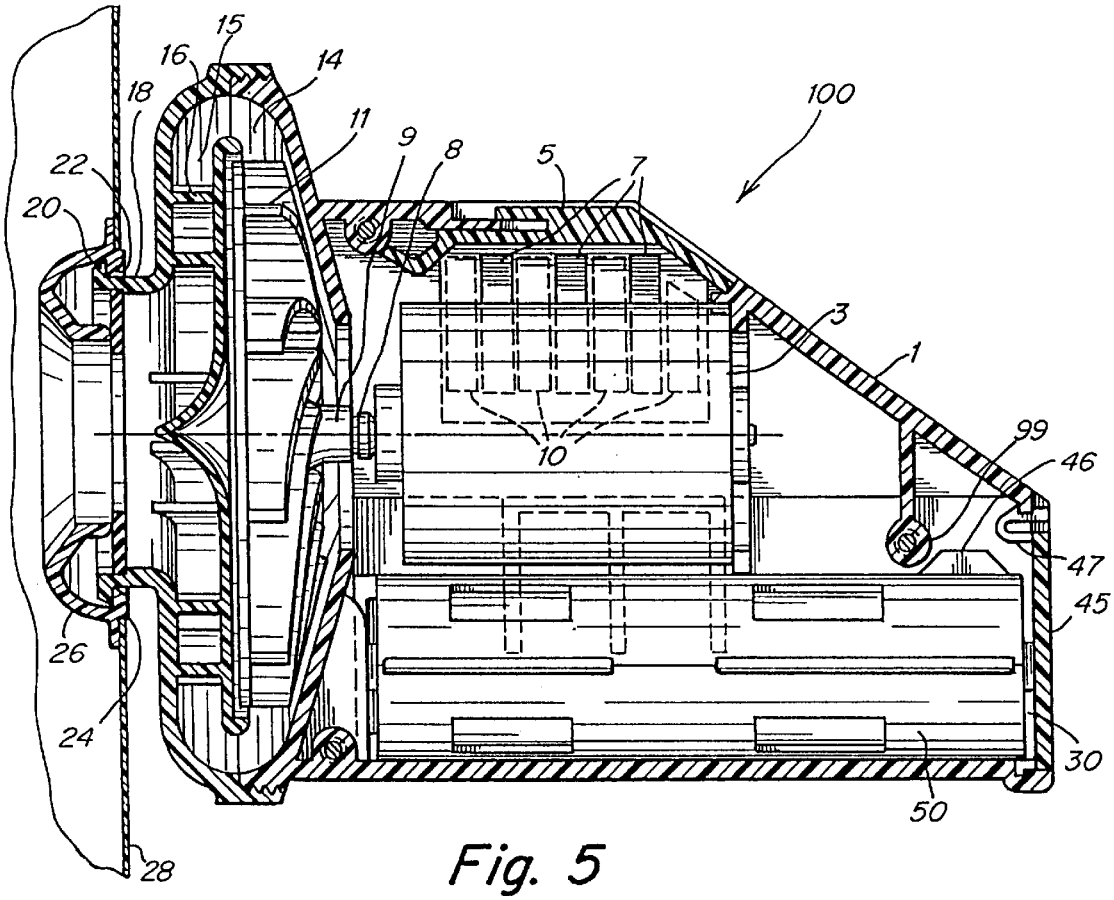
FIG. 5 is a side sectional view of the fluid moving device illustrating its components arrangement and connection to an inflatable receptacle via an inflation valve.

Unless otherwise indicated, the following description is made with reference to FIG. 5. The preferred embodiment of the fluid moving device 100 of the invention as herein disclosed, is to be used as an inflation device that will completely inflate and pressurize inflatable articles up to approximately ½ psi. It is to be appreciated that larger capacity versions of this fluid moving device can be made to provide more pressure such as, for example, up to 4 psi. It is to be appreciated that in a preferred embodiment of the invention, air is the fluid that is moved and that may be modified in pressure by the fluid moving device, however, the device of the invention is not limited to air moving devices and can include any fluid moving device as defined by the claims.

The fluid moving device of this invention is preferably used with inflatable receptacles that incorporate a valve which allows rapid transfer of fluid into the inflatable receptacle (at least 10 cfm.) at low pressure. It is to be appreciated that an inflatable receptacle as used herein is to include any receptacle that can receive a fluid, and in a preferred embodiment, includes inflatable articles having a valve assembly that mates with the fluid moving device such as, for example, mattresses, toys, floats, and the like. An example of such a valve 26, shown in combination with an inflatable receptacle 28, is illustrated in FIG. 5. A preferred embodiment of this inflation valve has a fluid transfer orifice of approximately ¾ sq. in., which does not unduly restrict fluid flow from the fluid moving device to the inflatable receptacle. The combination of the inflation valve and the inflatable receptacle, when coupled with the fluid moving device 100, provides an easy-to-use, inexpensive, fast and efficient way to move fluid into and to pressurize most low-pressure inflatable receptacles.

Figure 7:
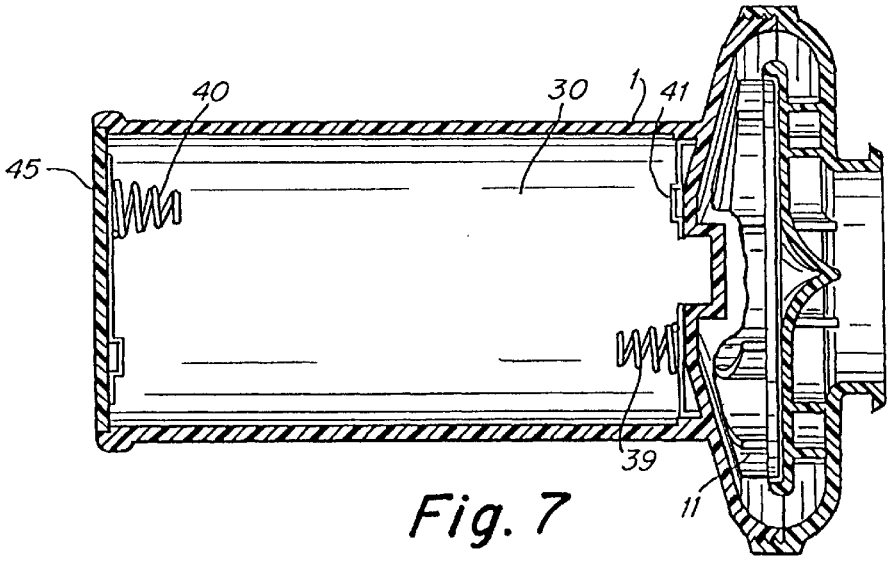
FIG. 7 is a cross-sectional top view of the fluid moving device including an embodiment of a battery compartment.
Figure 8:
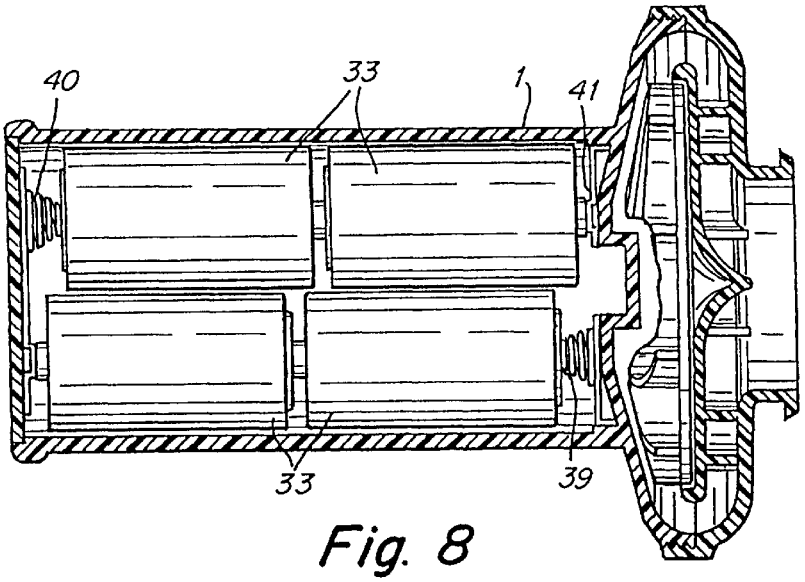
FIG. 8 is a cross-sectional top view of the fluid moving device showing the battery compartment with conventional batteries installed.
Figure 9:
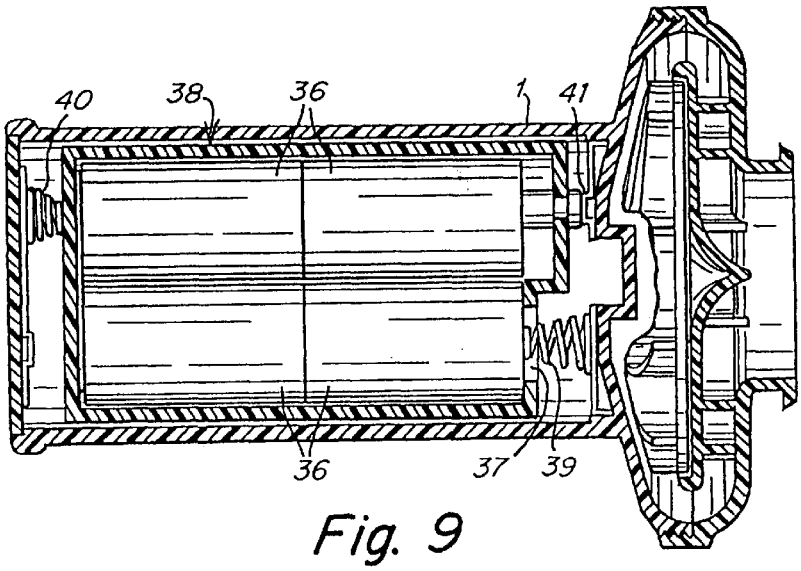
FIG. 9 is a cross-sectional top view of the fluid moving device showing the battery compartment with a battery pack for rechargeable-type batteries installed.

The preferred embodiment of the fluid moving device is battery operated. It includes a housing 1 with a motor 3, an impeller 11 and a power switch 5. A battery power source affords maximum portability. Referring now to FIGS. 7–9, to address cost/performance issues which may be important to users of this device, the fluid moving device 100 includes a battery chamber 30 which will accept either a more readily available, lower-cost conventional battery such as, for example, an alkaline battery 33 or a higher-cost, enhanced performance rechargeable-type battery such as, for example, a nickel cadmium battery 36.

Referring to FIG. 5 and FIG. 7, with the removal of panel 45, located at one end of the battery compartment 30, batteries may be inserted into the battery compartment of the fluid moving device. A spring latch 47 (see FIG. 5) located on the panel secures the panel to the housing. Manual depression of the spring allows the panel to be removed. When the panel is installed in the housing, it maintains the batteries in an operable condition within the battery compartment 30.

Referring now to FIG. 9, there is illustrated an embodiment of a battery pack configuration 38, which fits into the battery chamber 30 of the fluid moving device and that is dimensionally interchangeable with the conventional batteries 33 as illustrated in FIG. 8. The embodiment of the battery pack illustrated in FIG. 9 includes a slot 37 which allows the battery pack to mate with a spring 39. The spring 39 enters into the slot and the slot 37 is configured such that the battery pack mates with housing contact 41. The spring 39 and spring 40 of the battery compartment provide equal and opposite forces on the battery pack such that the battery pack can make appropriate contact to the housing contact 41. The housing contact is coupled to the various components of the fluid moving device that require power. Accordingly, the battery pack is provided with the slot to allow this electrical connection to the housing contact.

Figure 10:
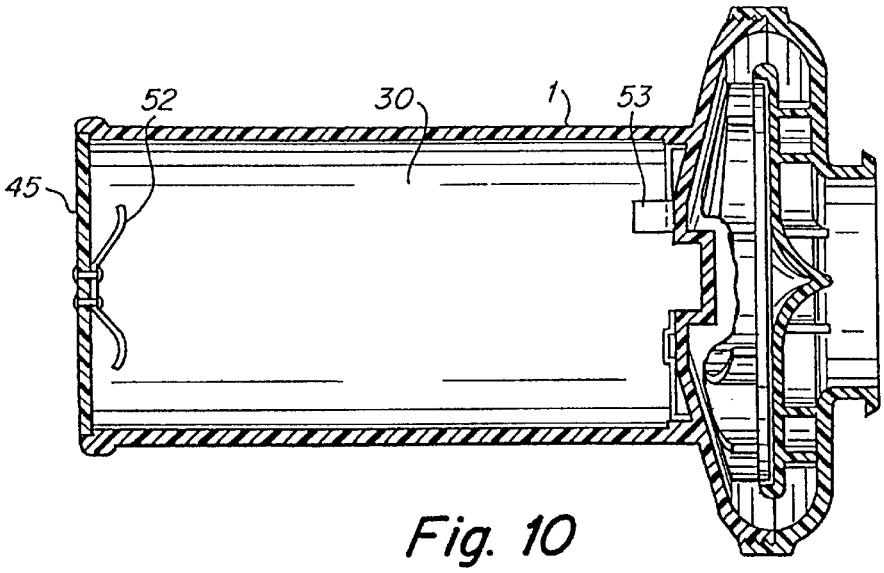
FIG. 10 is a cross-sectional top view of the fluid moving device illustrating another embodiment of a battery compartment.
Figure 11:
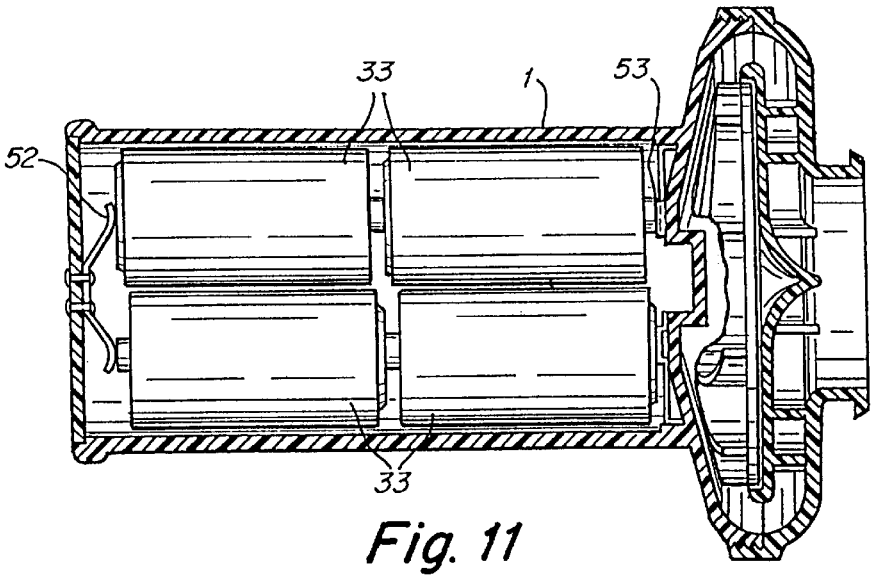
FIG. 11 is a cross-sectional top view of the fluid moving device illustrating the battery compartment of FIG. 10, with conventional batteries installed.
Figure 12:
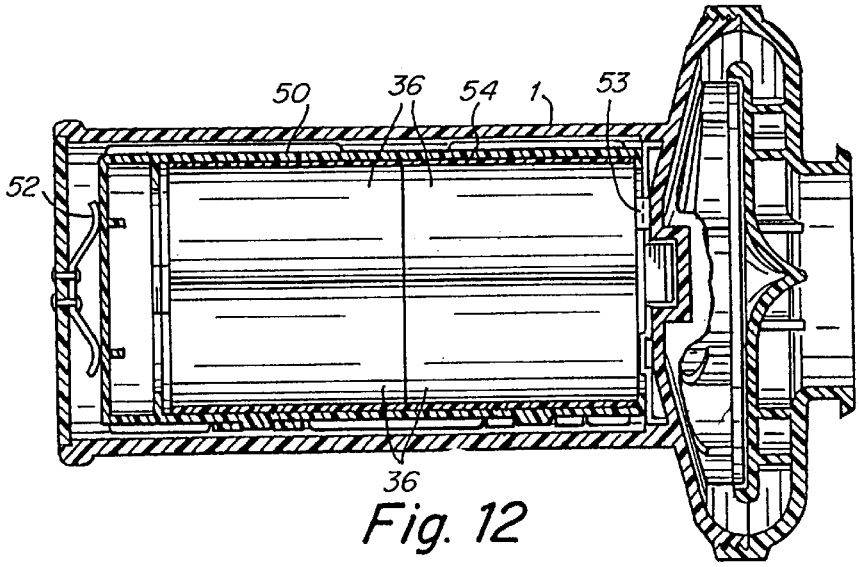
FIG. 12 is a cross-sectional top view of the fluid moving device illustrating the battery compartment of FIG. 10, and illustrating a battery pack having rechargeable-type batteries installed within a battery container and disposed within the battery compartment.

As the physical requirements for interchangeability of the batteries such as, for example, size and shape of the conventional and rechargeable-type batteries vary, a mechanism is needed to insure that all battery options will fit and properly function within the fluid moving device's battery compartment 30. Referring now to FIG. 10, in the preferred embodiment of the fluid moving device, the battery compartment is sized to accommodate a plurality of C-size alkaline batteries. Therefore, there is needed a mechanism to allow for a battery size that is either larger or smaller than the conventional C-size alkaline battery.

As will be discussed in further detail infra, one such mechanism that may be used to achieve size compatibility is a battery pack that holds differently sized batteries, and that is compatibly sized to fit within the battery compartment 30. An example of such a battery pack 38 is illustrated in FIG. 9 and is discussed supra. An additional example of such a battery pack will be illustrated infra.

Figure 13A:
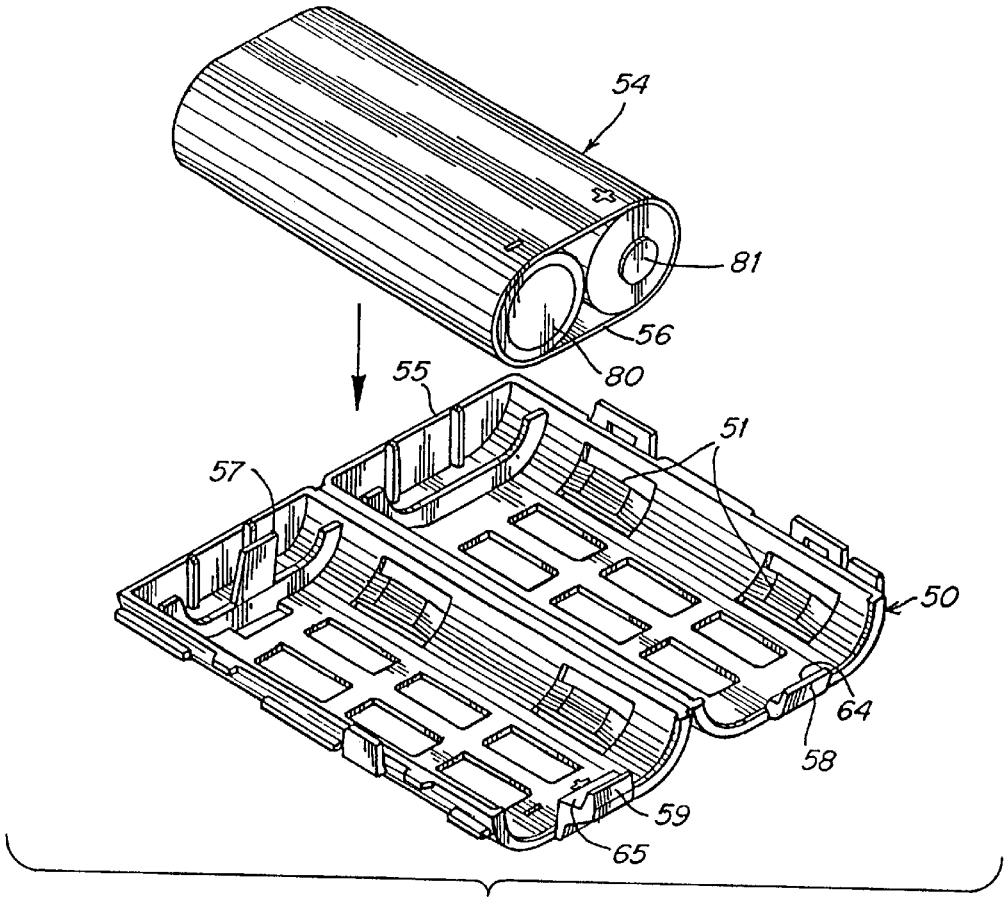
FIGS. 13A and 13B are perspective views of the battery container, and the battery pack including rechargeable batteries of FIG. 12, and a battery charging adaptor of the invention.
Figure 13B:
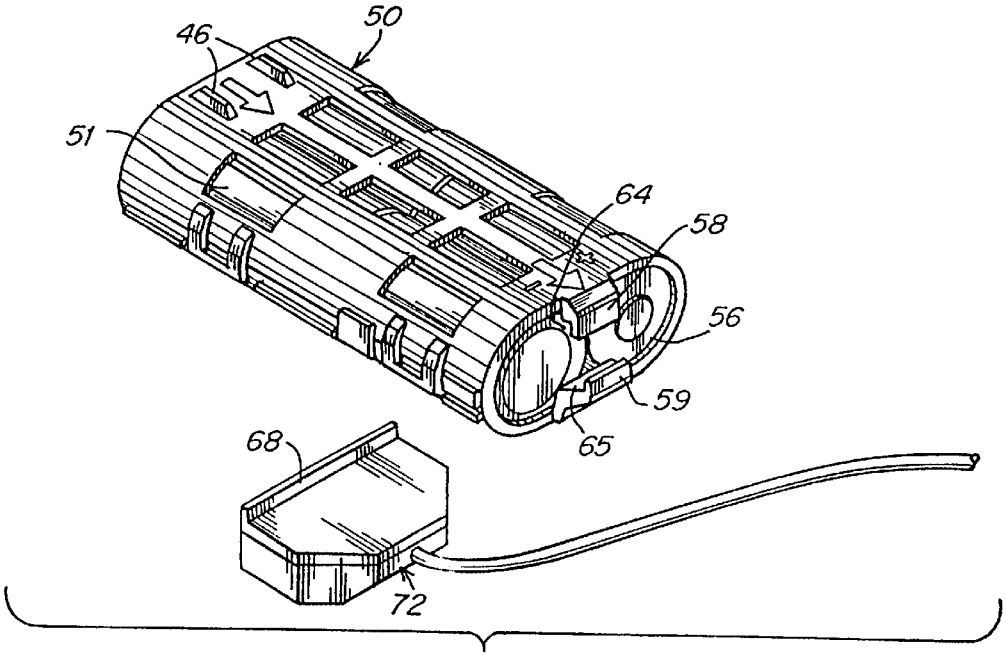

Another mechanism that may be used to provide the above-described compatibility of differently sized batteries with the battery compartment, is a reusable battery container 50 that is compatible in size with the C-size alkaline battery such as is illustrated in FIGS. 13A, 13B and FIGS. 15A, 15B, and that may also house a variety of smaller or differently sized batteries or battery packs. The battery container is adaptable to accept various battery types and sizes of batteries including, for example, multiple sizes of nickel-cadmium and nickel-metal hydride batteries. Referring to FIGS. 13A, 13B, a surface of the battery container incorporates at least one spring 51 that may be disposed at a plurality of locations, which may securely hold batteries of, for example, different diameter in the battery container. An interior of the battery container also includes at least one spring 57 that may maintain batteries of different length in a desired operating position within the battery container. The interior of the battery container can be further reconfigured to accommodate batteries of substantially different length by, for example, moving or changing a position of the spring 57.

FIG. 10 illustrates an embodiment of the fluid moving device which will accept such a battery container 50. The fluid moving device includes spring contacts 52, 53 at opposite ends of the battery compartment 30. This pair of spring contacts helps to assure electrical contact between any of the batteries, the battery pack and the battery container and the housing contact (not illustrated) of the fluid moving device, regardless of which battery option is used.

Referring again to FIG. 5, any of the battery container 50 and the battery pack 38 may be provided with a tab 46 (see also the battery container as illustrated in FIG. 13) that assures proper orientation of the battery pack or the battery container within the fluid moving device. In particular, the fluid moving device includes a protrusion 99 that prevents the battery pack or the battery container from being inserted into the fluid moving device in an improper orientation. In particular, the protrusion 99 prevents the tab 46 on the battery pack or the battery container from sliding past the protrusion, thus assuring that the battery pack or the battery container can be inserted into the battery compartment 30 in only one orientation. The structure is useful, for example, to prevent the battery pack or batteries within the battery container from inadvertently being shorted out due to improper orientation in the battery compartment and improper contact to the spring contact 52 of the battery compartment (see FIG. 10).

Referring now to FIGS. 13A and 13B, there is illustrated an embodiment of the battery container 50, which houses, for example, differently sized rechargeable battery types. In the preferred embodiment, the battery container can accept smaller than C-size rechargeable battery sizes and may also be configured, with a slight modification, to house larger than C-size rechargeable batteries. In particular, in the preferred embodiment, the battery container accepts any battery size below C-size without any modification. Accordingly, it is to be appreciated that although the preferred embodiment of the battery container of the invention is illustrated with C-type batteries, any battery option or size can be used within the battery container of the invention.

Figure 14A:
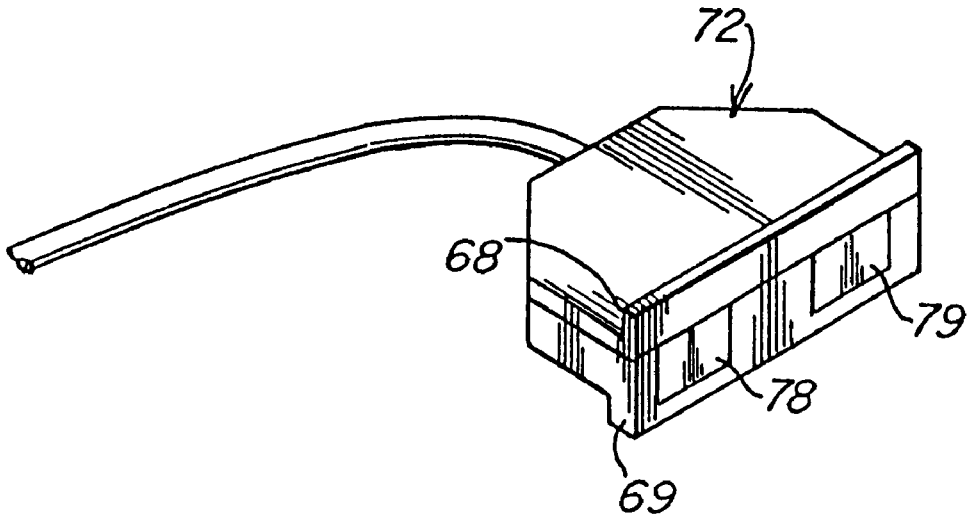
FIGS. 14A and 14B are perspective views, front and rear respectively, of the battery charging adaptor of FIG. 13B.
Figure 14B:
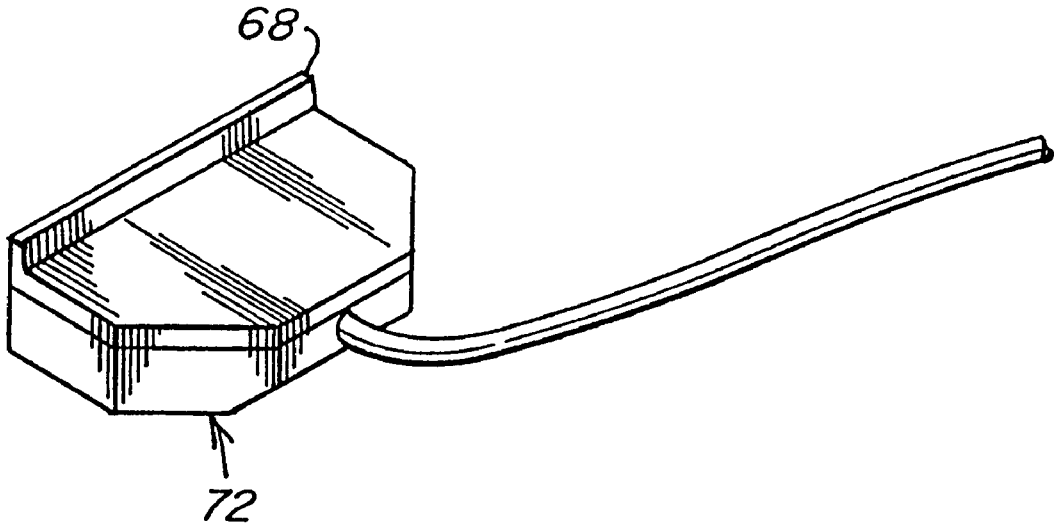
Figure 15A:
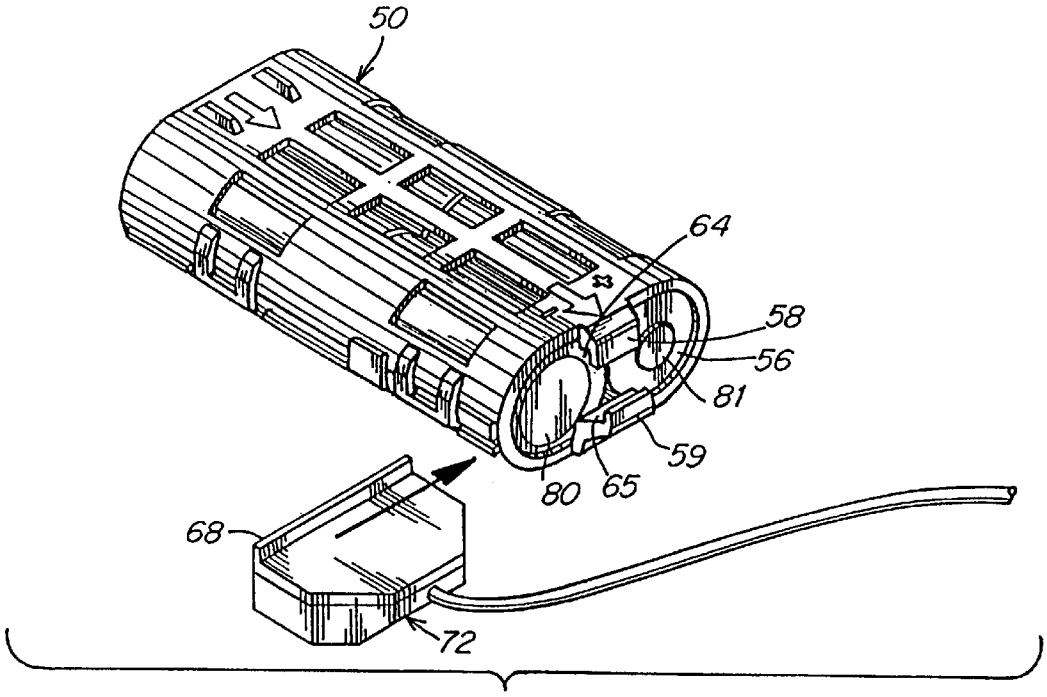
FIGS. 15A and 15B are perspective views of the battery container, the battery pack and the battery charging adaptor of FIG. 13B, illustrating connection of the battery charging adaptor to the battery pack and battery container.
Figure 15B:
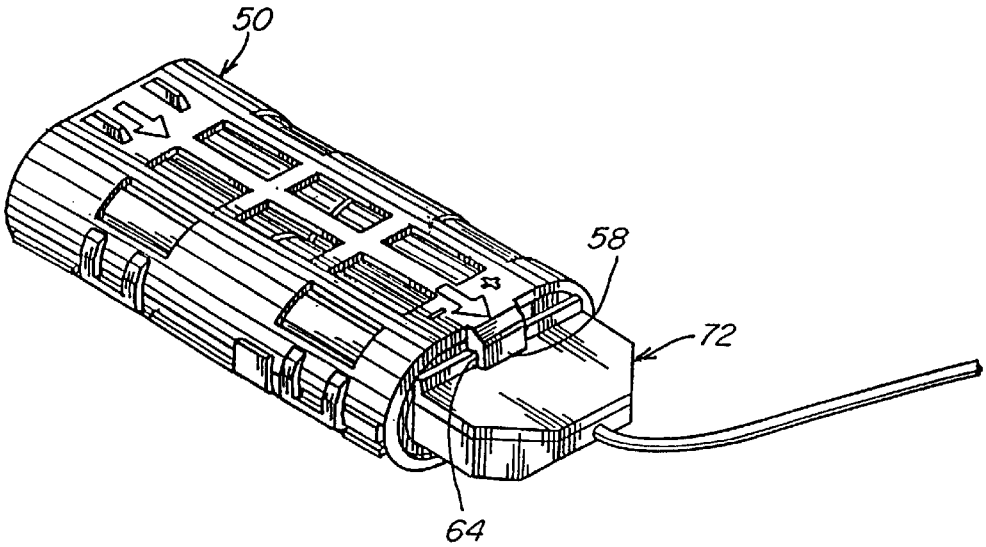

The battery container may also be provided with a structure that allows rechargeable batteries contained within the battery container to be recharged while the rechargeable batteries are within the battery container, thereby eliminating the need to remove the rechargeable batteries or the battery pack from the container with every charge. FIGS. 13A, 13B and 15A, 15B illustrate a rechargeable battery pack 54 having a terminal end 56 disposed within the battery container 50. The battery container 50 is provided with a pair of tabs 58, 59 extending from an end of the battery container, that have a rib configuration which create slot sections 64, 65. The slot sections mate with ribs 68, 69 on a battery charging device 72. The battery charging device 72 may slide into a charging position as illustrated in FIG. 15B, whereby the ribs align and secure terminals 78, 79 on the battery charging device (see FIG. 14A) and contact with battery terminals 80, 81 of the battery pack, thereby enabling recharge of the battery pack.

The battery container 50 also may be used to provide structure for protecting the rechargeable battery pack 54 for transportation or storage such as, for example, when the rechargeable battery pack is carried outside of the fluid moving device's battery compartment, or may be used to provide additional security against inadvertent activation of the fluid moving device such as, for example, when the fluid moving device is transported with the battery pack disposed within the fluid moving device. For either of these scenarios, it is advantageous and useful to protect the exposed battery terminals 80, 81 and to eliminate inadvertent activation of the fluid moving device due to contact with the battery terminals. This protection of the battery terminals may be achieved by reversing the position of the rechargeable battery pack within the battery container so that an exposed end of the battery pack cannot make contact with the housing contact 41 (see FIG. 9), and so that the battery terminals 80, 81 are situated at a protected, non-active end 55 of the battery container (see FIG. 13A).

An advantage of the interchangeability of the conventional batteries, differently sized rechargeable batteries and the rechargeable battery pack 54, is that the user is provided with a cost/performance option, wherein the user can select the lower-cost, readily available conventional batteries which may not provide as much output power, but typically have a longer run time than an option such as the rechargeable battery pack. Alternatively, the user can select, for example, the rechargeable battery pack which although more expensive, provides a higher output and therefore runs the fluid moving device at a higher throughput of fluid at increased pressure, and also provides the option to recharge the battery pack so that it is reusable. It should also be appreciated that any of the interchangeable battery pack 38, the rechargeable battery pack 54 which has been illustrated as mating with the battery container 50, the battery container including any sized batteries, the standard sized batteries, and the battery compartment 30 that accommodates any of these interchangeable options, are not limited to a fluid moving device. In particular, it is to be appreciated that the battery container, the battery pack and the battery compartment of this invention can be used with any battery-operated device.

As stated above, the objective of having multiple power sources available with the fluid moving device and which are containable within the fluid moving device housing, is to provide the user with the choice in selecting the user's preferred battery option as well as performance option which suits the user's needs. However, it is to be appreciated that the fluid moving device of the invention need not contain the interchangeable power source and can also be configured with, for example, a set of rechargeable batteries permanently installed within the fluid moving device so that the rechargeable batteries can be recharged within the fluid moving device by attaching the battery charging connector to a suitable connector on the fluid moving device itself. Nevertheless, it is to be appreciated that an advantage of the removable and rechargeable battery container or removable battery pack and the battery compartment of the fluid moving device configured to accommodate the removable battery container and the removable battery pack of the invention, is that the fluid moving device may be operated by an additional power source even when the battery container or battery pack has been removed from the battery compartment such as, for example, to charge the battery container or the rechargeable battery pack. Therefore, it is an advantage of this embodiment of the fluid moving device of the invention, that the operating time of the fluid moving device may be extended beyond that of an fluid moving device having the rechargeable battery pack completely and permanently enclosed within the fluid moving device.

In the preferred embodiment of the fluid moving device, any of the above-described battery sources may be used interchangeably to power the motor driven impeller 11 (see FIG. 5) which produces a fluid flow, and which may modify a pressure of the fluid to inflate a fluid moving device.

Figure 6:
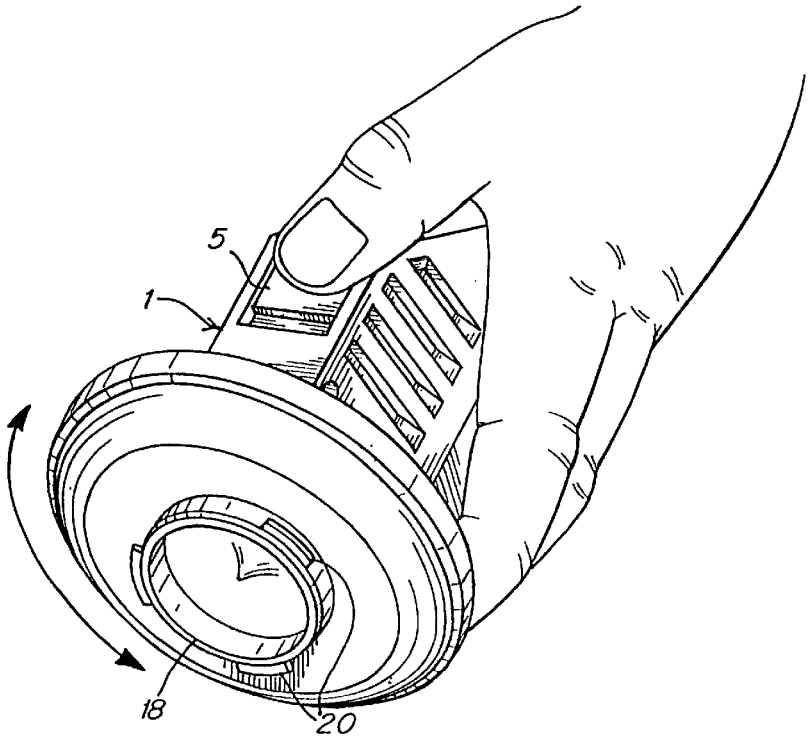
FIG. 6 is a perspective front view of the fluid moving device, shown being held in a "ready" position for both powering ON the fluid moving device and for engaging or disengaging with a receptacle via an inflation valve.

Referring now to FIGS. 1–6, it is to be appreciated that another aspect of the fluid moving device of the invention is its hand-holdable housing assembly. In order to optimize performance of the battery source, motor 3, and impeller 11, these components have been incorporated into an ergonomically efficient, hand-holdable housing 1 having both a multi-purpose user grip and a multi-purpose power switch 5. Referring to FIG. 6, the hand-holdable housing allows a user to hold the fluid moving device with the multi-purpose user grip within the user's hand so that the multi-purpose power switch 5 is proximate to and readily accessible by the user's thumb. Essentially, the hand-holdable housing, the multi-purpose user grip, and the multi-purpose power switch are for holding and switching ON or OFF the fluid moving device and also for moving the fluid moving device into and out of a coupled position with the aforementioned valve 26 of an inflatable receptacle (connection with the valve is shown in FIG. 5).

Figure 1:
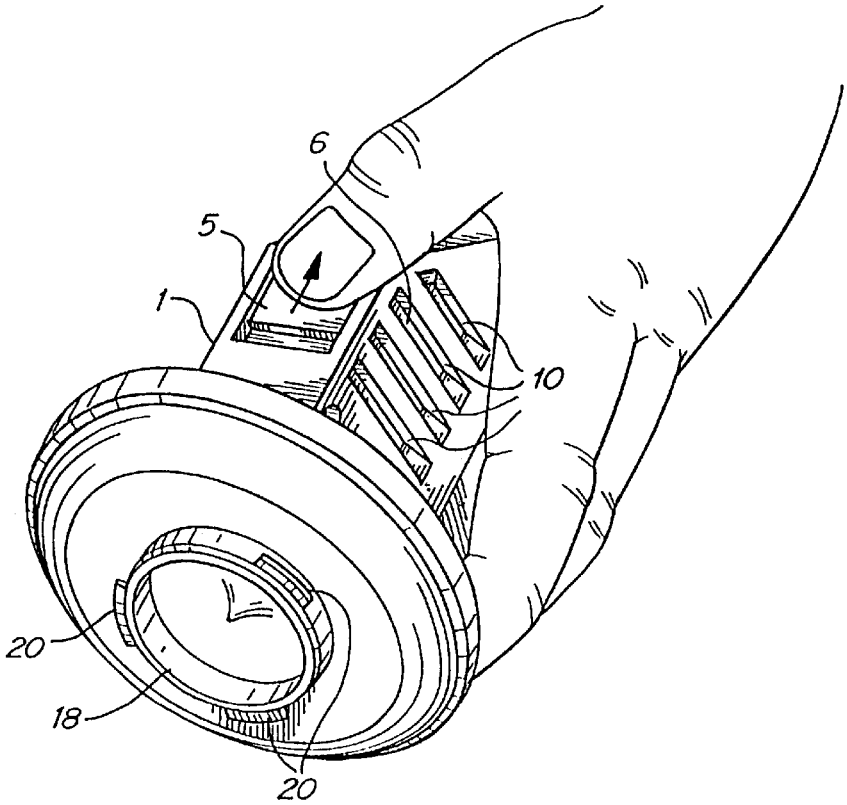
FIG. 1 is a perspective front view of a hand held fluid moving device, shown being held in a power OFF mode.
Figure 2:
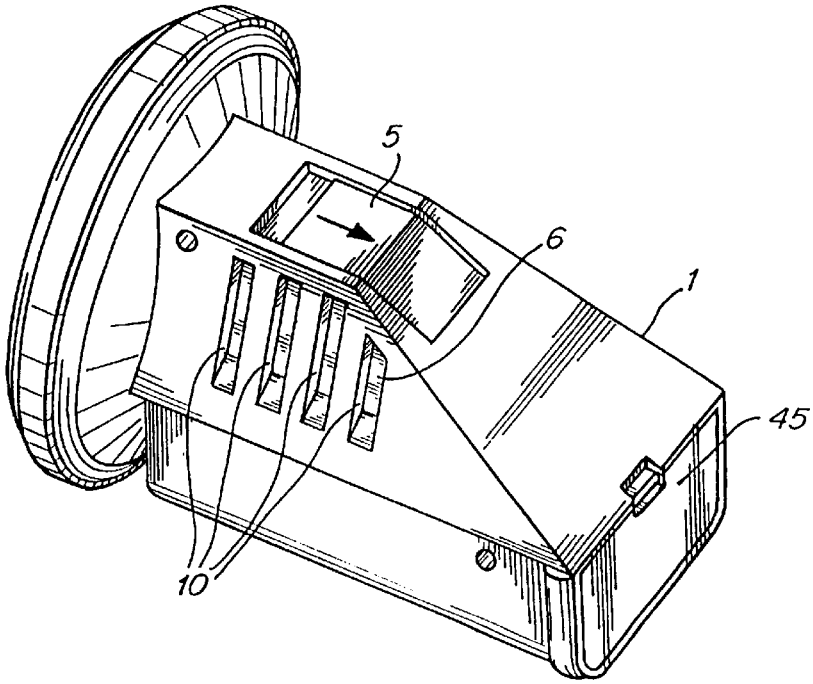
FIG. 2 is a perspective side view of the fluid moving device, illustrating a switch in a power OFF position and air vents in a closed position.
Figure 3:
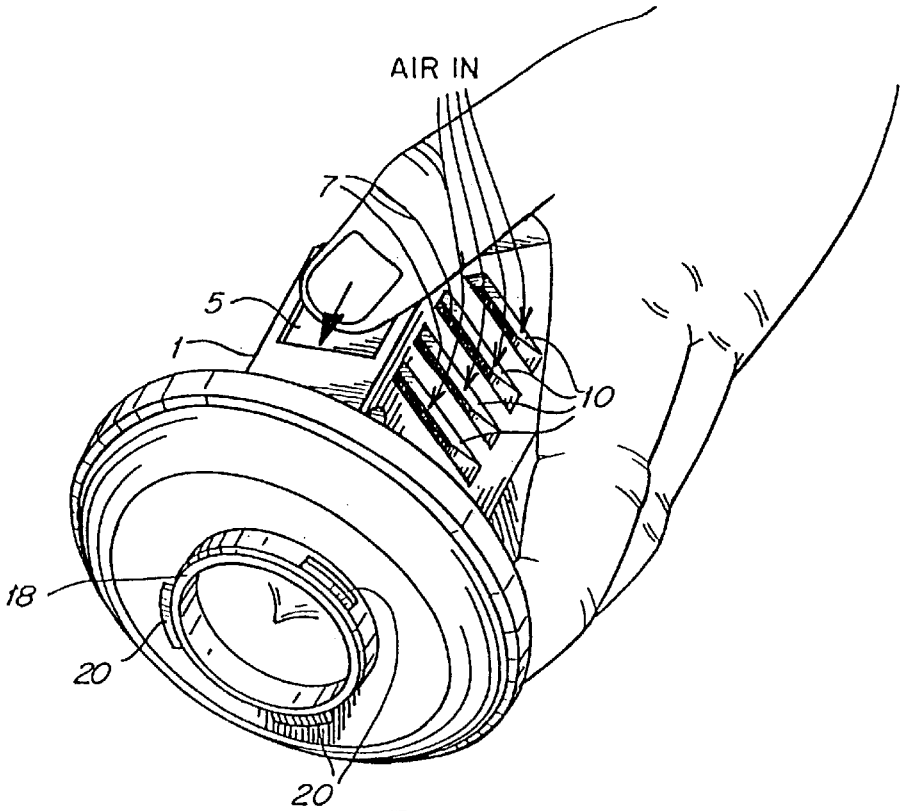
FIG. 3 is a perspective front view of the hand held fluid moving device, shown being held in a power ON mode.
Figure 4:
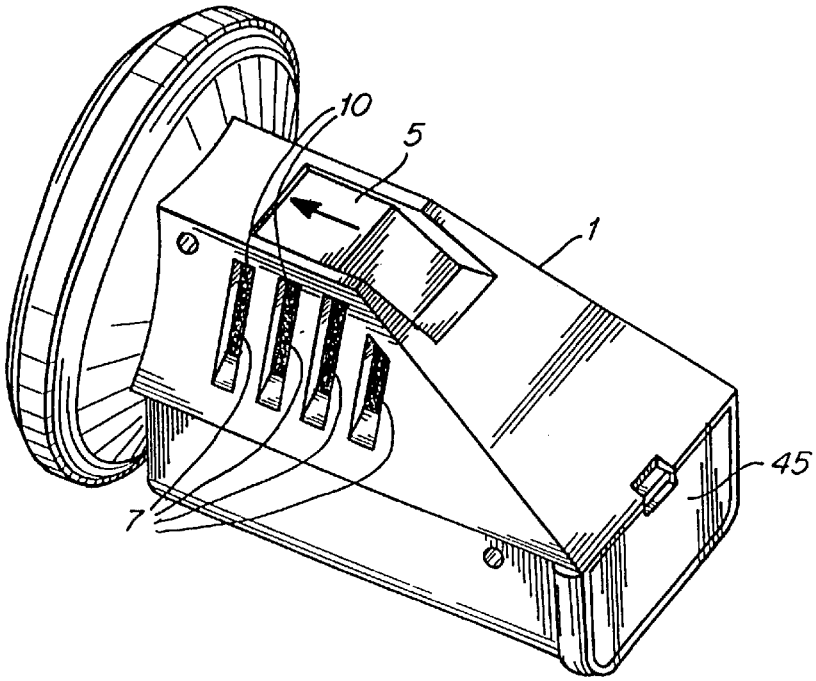
FIG. 4 is a perspective side view of the fluid moving device, showing the switch in a power ON position and the air vents in an open position.

Coupling the fluid moving device 100 with the inflation valve 26 via a mechanical interlock simplifies the inflation process by eliminating the need for manual support of the fluid moving device to maintain an airtight connection during inflation. FIGS. 3 and 5–6 illustrate a preferred embodiment of a mechanical interlock assembly of the invention, having projecting tabs 20 located on the housing proximate to a fluid transfer orifice 18, which engage with mating projections 22 of the inflation valve located near an outer rim 24 of the inflation valve. The hand-holdable housing provides for both right-hand and left-hand operation and allows the fluid moving device to be rotated both clockwise and counter-clockwise to respectively engage and disengage with the inflation valve.

Operation of the fluid moving device will now be described with respect to FIGS. 1–6. When the fluid moving device is active (ON), rotation of the impeller 11 draws fluid into the housing through self-sealing intake ports 10. This fluid then passes through the impeller chamber 14, where it may be pressurized and then ejected from the hand-holdable housing at the fluid transfer orifice 18. In order to maximize the efficiency and power output of the battery, motor, and impeller combination, an exit side 15 of the impeller chamber 14 includes a series of stationary vanes 16 which direct the path of fluid as it leaves the impeller chamber and flows from the fluid moving device. By better channeling the exit fluid path, the stationary vanes enhance performance, improving the device's capacity to fill and pressurize an inflatable receptacle.

In a preferred embodiment of the motor and impeller combination of the fluid moving device of the invention, it will be appreciated that the motor/impeller combination eliminates the need for additional mechanical attachment of the impeller to a motor shaft in order to prevent axial movement of the impeller on the motor shaft. In particular, in the preferred embodiment, impeller blades of the impeller face the motor such that any axial load on the impeller is in the direction of the motor. In addition, a hub 9 of the impeller abuts against a bushing 8 on the motor shaft, so that any axial movement is prevented. It is further to be appreciated that although the preferred embodiment of the fluid moving device has a motor and impeller, other arrangements of fluid moving devices, for example a diaphragm and pump, that are known to those of skill in the art are also within the scope of the invention as defined by the claims.

Because the preferred embodiment of the fluid moving device is portable, it may be used in a variety of situations both indoors and out. In these varied operating environments, the fluid path through the fluid moving device via the self-sealing intake ports 10 may also place the fluid moving device's internal components in close proximity to threatening environmental debris such as dirt, sand, miscellaneous particulate matter, and the like. Accordingly, another aspect of the fluid moving device of the present invention is self-sealing structure that seals the internal components of the fluid moving device when the power switch of the fluid moving device is in the OFF or deactivated position.

Figure 16:
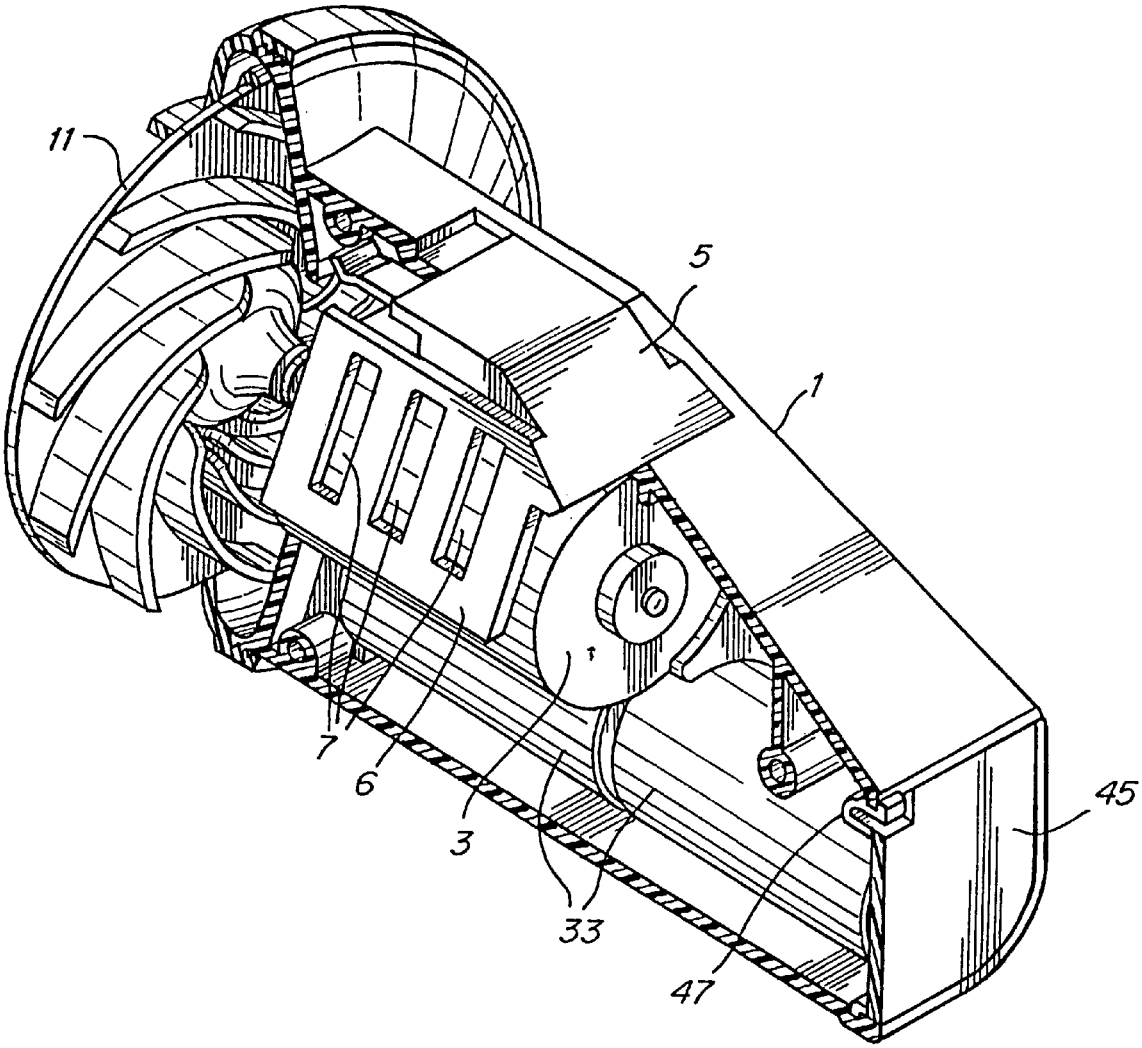
FIG. 16 is a cutaway side perspective view of the fluid moving device having a power switch, and showing an arrangement of interior components with conventional batteries installed.

Referring now to FIG. 16, to limit the exposure to foreign matter, the preferred embodiment of the fluid moving device intentionally recesses the self-sealing intake port 10 behind an exterior perimeter of the device. In particular, the power switch 5 has a pair of side members 6 with a series of counter-slots 7 which move with the power switch to open the self-sealing intake vent when the power switch is moved out of the deactivated position toward an ON position, and to seal the intake vent with movement of the power switch to the OFF position (See FIGS. 1–4). This ensures that exposure of the self-sealing intake port 10 occurs only while the fluid moving device is operating, thereby reducing the potential for contamination of electromechanical components of the fluid moving device.

It is also to be appreciated that in the preferred embodiment of the invention, which is intended for portable applications, the housing 1 and all components used in the device have been integrated so as to minimize size and weight, thereby improving convenience and ease of operation. In particular, it is to be appreciated that hand-holdable as used herein, is intended to include any fluid moving device that is size and that is light enough to be held in a hand of a user, and preferably is a palm-sized device that may fit in a palm of a user and be activated by a single finger of the user. This integration includes the options such as the nickel cadmium battery, which provides a power output to size and weight ratio appropriate to portable application of the device.

Having thus described at least one illustrative embodiment of the invention, various alterations, modifications and improvements will readily occur to those skilled in the art. Such alterations, modifications and improvements are intended to be within the scope of the invention. Accordingly, the foregoing description is by way of example only and is not intended as limiting. The invention is limited only as defined in the following claims.

What is claimed is:

1. A device for filling a receptacle with a fluid, the device comprising:

an intake port that provides for a fluid to be drawn into the device;

a pump for moving the fluid through the device to provide the fluid for filling the receptacle;

a fluid transfer orifice that provides the fluid to the receptacle;

a power switch for manually activating and deactivating the pump;

a battery compartment having a size, arrangement and electrical contacts to accommodate and provide electrical connection between a standard size set of batteries and the pump; and a hand-holdable housing that houses the intake port, the pump, the fluid transfer orifice, the power switch, and the battery compartment, the hand-holdable housing being shaped and arranged so that it may be cradled in one hand of a user, the hand-holdable housing allowing the fluid transfer orifice to be rotated into and out of engagement with the receptacle and also allowing the user to move the switch with the same one hand to activate and deactivate the device.

2. The device as claimed in claim 1, further comprising rechargeable batteries installed in the battery compartment.

3. The device as claimed in claim 1, further comprising a removable battery container sized and arranged to adapt differently sized batteries to the size and arrangement of the battery compartment, so that the differently sized batteries can be electrically connected to the electrical contacts of the battery compartment.

4. A fluid moving device comprising:

a self-sealing intake port that provides for a fluid to be drawn into the fluid moving device;

a pump for moving the fluid through the fluid moving device;

a fluid transfer orifice that provides the fluid;

a battery compartment having a size, arrangement and electrical contacts to accommodate and provide electrical connection between a standard size set of batteries and the pump; and a power switch for activating and deactivating the pump, wherein the power switch includes a self-sealing structure that seals the self-sealing intake port when the power switch is in a deactivated position, and that unseals the self-sealing intake port when the power switch is not in the deactivated position.

5. The device as claimed in claim 4, further comprising a removable battery container sized and arranged to adapt differently sized batteries to the size and arrangement of the battery compartment, so that the differently sized batteries can be electrically connected to the electrical contacts of the battery compartment.

6. The fluid moving device as claimed in claim 5, wherein the removable battery container includes means for assuring proper orientation of the removable battery container in the battery compartment.

7. A fluid moving device, comprising:

a housing sized and adapted to be cradled in a single hand;

a fluid pump positioned within the housing such that at least a portion of the fluid pump is positioned within the single hand when the housing is cradled in the single hand, and sized and arranged to move fluid through at least a portion of the housing; and a power switch positioned on the housing and coupled to the pump and a power source, the power switch being switchable to activate and deactivate the fluid pump.

8. The fluid moving device of claim 7, further comprising:

an inlet in the housing through which fluid is brought into the fluid moving device;

an outlet in the housing through which fluid is exhausted from the fluid moving device, the outlet being sized and adapted to be rotated into and out of engagement with a fluid receptacle.

9. The fluid moving device of claim 8, further comprising an interlock connector disposed adjacent to the outlet and having projecting tabs that engage with the fluid receptacle.

10. The fluid moving device of claim 7, wherein the fluid pump comprises an impeller coupled to the power switch, that rotates to move fluid through the at least the portion of the housing.

11. The fluid moving device of claim 10, wherein the fluid pump comprises an electric motor coupled to the power switch and the impeller, that rotates the impeller when the fluid pump is activated.

12. The fluid moving device of claim 11, wherein the impeller comprises a hub that abuts against a bushing that is on a shaft of the electric motor, wherein the impeller further comprises blades that face the motor, and wherein a back surface of the impeller faces an outlet in the housing.

13. The fluid moving device of claim 7, wherein the power switch is positioned on the housing such that it is the accessible to a finger of the single hand cradling the housing.

14. The fluid moving device of claim 7, wherein the power switch includes a seal that at least partially seals an inlet in the housing when the power switch is in a deactivated position, and that unseals the inlet when the power switch is in an activated position.

15. The fluid moving device of claim 14, wherein the power switch includes a plurality of counter-slots that move with the power switch to at least partially seal a plurality of intake vents that make up the inlet when the power switch is in the deactivated position, and that move with the power switch to unseal the intake vents when the power switch is in the activated position.

16. The fluid moving device of claim 8, wherein the inlet includes a plurality of intake vents that are recessed from an outside wall of the housing.

17. The fluid moving device of claim 7, further comprising stationary vanes disposed adjacent to an outlet in the housing, that direct the fluid path to and through the outlet.

18. The fluid moving device of claim 7, further comprising a battery compartment.

19. The fluid moving device of claim 18, wherein the battery compartment is sized and arranged to accommodate, and to provide electrical connection with, a standard size set of batteries.

20. The fluid moving device of claim 18, further comprising a removable battery pack of batteries, the removable battery pack being sized and adapted to electrically connect with the battery compartment.

21. The fluid moving device of claim 20, wherein the removable battery pack is sized and adapted to fit within the battery compartment.

22. The fluid moving device of claim 18, further comprising rechargeable batteries installed in the battery compartment.

23. The fluid moving device as claimed in claim 18, further comprising a removable battery container sized and arranged to adapt batteries to the size and arrangement of the battery compartment, so that the batteries can be electrically connected to the battery compartment.

24. The fluid moving device as claimed in claim 23, wherein the batteries are rechargeable batteries.

25. The fluid moving device as claimed in claim 23, wherein the removable battery container includes a slot that allows the rechargeable batteries to make electrical contact with the battery compartment of the device.

26. The fluid moving device as claimed in claim 23, wherein the removable battery container includes structure for coupling the removable battery container and the rechargeable batteries to a battery charging device.

27. The fluid moving device as claimed in claim 26, wherein the structure includes a pair of tabs extending from one end of the removable battery container, each tab having a ribbed configuration that creates a slot section of each tab.

28. The fluid moving device as claimed in claim 27, wherein the slot sections of the pair of tabs are sized and arranged to cooperatively mate with the battery charging device and to bring terminals of the rechargeable batteries into contact with the battery charging device.

29. The fluid moving device as claimed in claim 23, wherein the removable battery container is constructed and arranged so that it may be opened and closed to accommodate removal, replacement, or altering of a position of the batteries.

30. The fluid moving device as claimed in claim 23, wherein the removable battery container is constructed and arranged to be internally rearrangeable so that the removable battery container can accommodate a plurality of size and type batteries.

31. The fluid moving device as claimed in claim 24, wherein the battery compartment includes at least one spring that biases the rechargeable batteries into electrical connection with the battery compartment.

32. The device as claimed in claim 23, wherein the removable battery container includes means for assuring proper orientation of the removable battery container in the battery compartment.

33. The device as claimed in claim 20, wherein the removable battery pack includes means for assuring proper orientation of the removable battery pack in the battery compartment.

34. The fluid moving device of claim 7, wherein the fluid pump is positioned within the housing such that the fluid pump is positioned within the single hand when the housing is cradled in the single hand.

* * * * *